US007618112B2

(12) United States Patent
Edamura et al.

(10) Patent No.: US 7,618,112 B2
(45) Date of Patent: Nov. 17, 2009

(54) RECORDING APPARATUS

(75) Inventors: Tetsuya Edamura, Kawasaki (JP); Kiichiro Takahashi, Yokohama (JP); Minoru Teshigawara, Yokohama (JP); Akiko Maru, Tokyo (JP); Yoshiaki Murayama, Tokyo (JP); Takatoshi Nakano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 75 days.

(21) Appl. No.: 11/843,585

(22) Filed: Aug. 22, 2007

(65) Prior Publication Data

US 2008/0049055 A1 Feb. 28, 2008

(30) Foreign Application Priority Data

Aug. 23, 2006 (JP) ..... 2006-226702

(51) Int. Cl.
*B41J 2/205* (2006.01)

(52) U.S. Cl. ..... 347/15; 347/43

(58) Field of Classification Search ..... 347/15, 347/40, 43, 12; 358/1.2, 1.9
See application file for complete search history.

(56) References Cited

U.S. PATENT DOCUMENTS

| | | | |
|---|---|---|---|
| 5,412,410 | A | 5/1995 | Rezanka |
| 6,966,629 | B2 | 11/2005 | Nakajima |

FOREIGN PATENT DOCUMENTS

| | | |
|---|---|---|
| JP | 06-238902 | 8/1994 |
| JP | 08-011298 | 1/1996 |
| JP | 2004-122757 | 4/2004 |
| JP | 2006-159798 | 6/2006 |

*Primary Examiner*—Lamson D Nguyen
(74) *Attorney, Agent, or Firm*—Canon USA Inc IP Div

(57) ABSTRACT

A recording apparatus includes a recording unit configured to record a first dot and a second dot having a diameter smaller than that of the first dot on a recording medium, and a scanning unit configured to move the recording unit in a scanning direction. A recording resolution of the second dot in the scanning direction is lower than a recording resolution of the first dot in the scanning direction.

3 Claims, 15 Drawing Sheets

FIG. 6A

| GRADATION VALUE | LARGE DOT (5pl) | SMALL DOT (1pl) |
|---|---|---|
| 0 | 0 0<br>0 0 | 0<br>0 |
| 1 | 0 0<br>0 0   0 0<br>0 0 | 1<br>0   0<br>1 |
| 2 | 0 0<br>0 0   0 0<br>0 0 | 1<br>1 |
| 3 | 1 0<br>0 0   0 0<br>1 0 | 1<br>0   0<br>1 |
| 4 | 1 0<br>0 1 | 0<br>0 |
| 5 | 1 1<br>1 1 | 0<br>0 |

FIG. 6B

| GRADATION VALUE | LARGE DOT (5pl) |
|---|---|
| 0 | 0 0<br>0 0 |
| 1 | 1 0<br>0 0   0 0<br>1 0 |
| 2 | 1 0<br>0 1 |
| 3 | 1 1<br>1 1 |

FIG. 10

| GRADATION VALUE | LARGE DOT (5pl) | MEDIUM DOT (2pl) | SMALL DOT (1pl) |
|---|---|---|---|
| 0 | 0 0<br>0 0 | 0<br>0 | 0<br>0 |
| 1 | 0 0<br>0 0 | 0<br>0 | 1<br>0   0<br>1 |
| 2 | 0 0<br>0 0 | 0<br>0 | 1<br>1 |
| 3 | 0 0<br>0 0 | 1<br>0   0<br>1 | 1<br>1 |
| 4 | 0 0<br>0 0 | 1<br>1 | 1<br>0   0<br>1 |
| 5 | 1 0<br>0 0   0 0<br>1 0 | 1<br>0   0<br>1 | 0<br>0 |
| 6 | 1 0<br>0 1 | 0<br>0 | 0<br>0 |
| 7 | 1 1<br>1 1 | 0<br>0 | 0<br>0 |

FIG. 11

| GRADATION VALUE | LARGE DOT (5pl) | MEDIUM DOT (2pl) | SMALL DOT (1pl) |
|---|---|---|---|
| 0 | 0 0<br>0 0 | 0 0<br>0 0 | 0<br>0 |
| 1 | 0 0<br>0 0 | 0 0<br>0 0 | 1<br>0    0<br>1 |
| 2 | 0 0<br>0 0 | 0 0<br>0 0 | 1<br>1 |
| 3 | 0 0<br>0 0 | 1 0<br>0 0    0 0<br>1 0 | 1<br>1 |
| 4 | 0 0<br>0 0 | 1 0<br>0 1 | 1<br>0    0<br>1 |
| 5 | 1 0<br>0 0    0 0<br>1 0 | 1 0<br>0 0    0 0<br>1 0 | 0<br>0 |
| 6 | 1 0<br>0 1 | 0 0<br>0 0 | 0<br>0 |
| 7 | 1 1<br>1 1 | 0 0<br>0 0 | 0<br>0 |

FIG. 12

| GRADATION VALUE | LARGE DOT (5pl) | MEDIUM DOT (2pl) | SMALL DOT (1pl) |
|---|---|---|---|
| 0 | 0 0 0 0<br>0 0 0 0 | 0 0<br>0 0 | 0<br>0 |
| 1 | 0 0 0 0<br>0 0 0 0 | 0 0<br>0 0 | 1<br>0   0<br>1 |
| 2 | 0 0 0 0<br>0 0 0 0 | 0 0<br>0 0 | 1<br>1 |
| 3 | 0 0 0 0<br>0 0 0 0 | 1 0<br>0 0   0 0<br>1 0 | 1<br>1 |
| 4 | 0 0 0 0<br>0 0 0 0 | 1 0<br>0 1 | 1<br>0   0<br>1 |
| 5 | 1 0 1 0<br>0 0 0 0   0 0 0 0<br>1 0 1 0 | 1 0<br>0 0   0 0<br>1 0 | 0<br>0 |
| 6 | 1 0 1 0<br>0 1 0 1 | 0 0<br>0 0 | 0<br>0 |
| 7 | 1 1 1 1<br>1 1 1 1 | 0 0<br>0 0 | 0<br>0 |

RECORDING APPARATUS

BACKGROUND OF THE INVENTION

1. Field of the Invention

The present invention relates to a recording apparatus configured to discharge ink droplets of different volumes and to record dots of different diameters on a recording medium.

2. Description of the Related Art

An inkjet recording apparatus records an image by discharging ink droplets of various colors from a plurality of ink discharge ports arranged on a recording head. Conventionally, an inkjet recording apparatus which forms dots of different diameters on a recording medium by discharging ink droplets of different volumes is known. For example, Japanese Patent Application Laid-Open No. 8-11298 discusses a method of forming small dots having small diameters at a higher resolution than large dots having large diameters on a recording medium.

FIG. 1B is a diagram showing the layout pattern of dots on one pixel for each gradation value. FIG. 1B shows an example of a dot layout on one pixel for representing each gradation value when large dots 100 and small dots 101 are formed. The horizontal axis corresponds to each gradation value, and the gradation value becomes higher from the left to the right. The layout of dots on one pixel is illustrated above the horizontal axis indicating each gradation value. FIG. 1B shows a dot layout in the case where small dots 101 are formed at a higher resolution as compared to large dots 100, as discussed in Japanese Patent Application Laid-Open No. 8-11298.

In such a dot layout pattern corresponding to each gradation value, a pixel is filled with large dots when the gradation value is highest. Consequently, a high recording density can be realized. Moreover, a large number of gradation levels can be represented in the intermediate region such that an image free of granular quality can be obtained.

However, in an inkjet recording apparatus, an air current generated along the discharged ink droplet causes displacement of the impact position of the ink droplet. Such displacement can lead to the degradation of image quality. In particular, when a high-resolution recording is performed, the number of ink discharges per unit time increases such that a large air current is generated. Consequently, the degradation of image quality increases due to the effect of the air current. Additionally, small ink droplets have less weight as compared to large ink droplets and are more prone to the effect of air current.

Therefore, when small dots are formed at a high resolution as discussed in Japanese Patent Application Laid-Open No. 8-11298, the position where the dot is formed is easily displaced due to the effect of air current, thus leading to the degradation of image quality.

SUMMARY OF THE INVENTION

The present invention is directed to a recording apparatus capable of reducing displacement of a position where a dot of a small diameter is formed, thus reducing the degradation of image quality.

According to an aspect of the present invention, a recording apparatus includes a recording unit configured to record a first dot and a second dot having a diameter smaller than that of the first dot on a recording medium, and a scanning unit configured to move the recording unit in a scanning direction, wherein a recording resolution of the second dot in the scanning direction is lower than a recording resolution of the first dot in the scanning direction.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 6A and 6B are pattern diagrams of dot layout patterns according to the first exemplary embodiment of the present invention.

FIG. 10 is a pattern diagram of dot layout patterns according to the third exemplary embodiment of the present invention.

FIG. 11 is a pattern diagram of dot layout patterns according to a fourth exemplary embodiment of the present invention.

FIG. 12 is a pattern diagram of dot layout patterns according to a fifth exemplary embodiment of the present invention.

DETAILED DESCRIPTION OF THE EMBODIMENTS

Various exemplary embodiments, features, and aspects of the invention will be described in detail below with reference to the drawings.

Figure 1A:
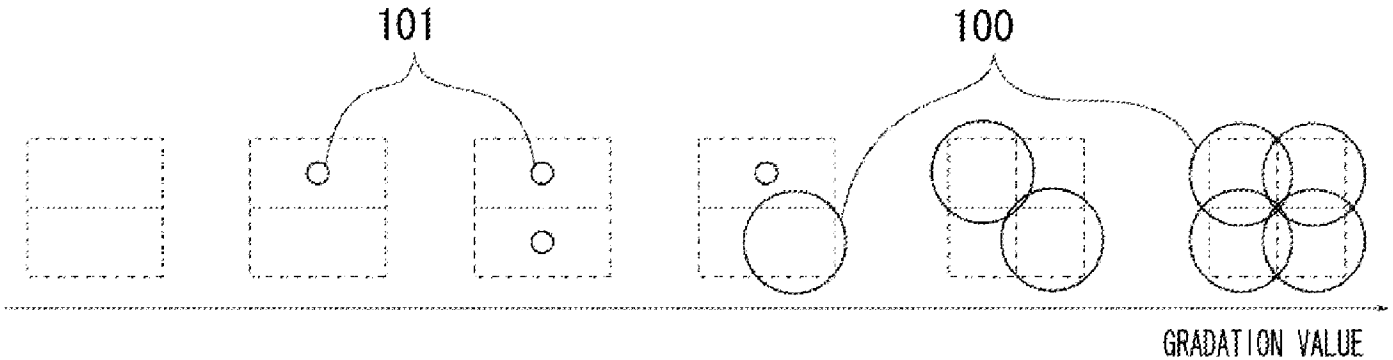
FIGS. 1A and 1B are pattern diagrams of a dot layout pattern for each gradation value in an inkjet recording apparatus according to an exemplary embodiment of the present invention and in a conventional inkjet recording apparatus, respectively.

In exemplary embodiments of the present invention, when a large dot (first dot) and a small dot (second dot) are formed on a recording medium to record an image, the small dot is formed at a lower resolution than the large dot. That is, the large dot is formed at a resolution of N dpi (dots per inch), e.g., 1200 dpi. The small dot is formed at a resolution of M dpi (M<N), e.g., 600 dpi. The layout of large and small dots on one pixel is determined for each gradation value as shown in FIG. 1A, and the large dots and small dots are recorded.

Furthermore, in addition to large and small dots, a medium dot of a diameter smaller than that of the large dot and greater than that of the small dot can be used to record an image. The image can be recorded with one of the following configurations:

1. Medium and small dots are formed at a low resolution, and large dots are formed at a high resolution.
2. Small dots are formed at a low resolution, and large and medium dots are formed at a high resolution.
3. Large dots, medium dots, and small dots are formed at resolutions of decreasing order.

First Exemplary Embodiment

Figure 2:
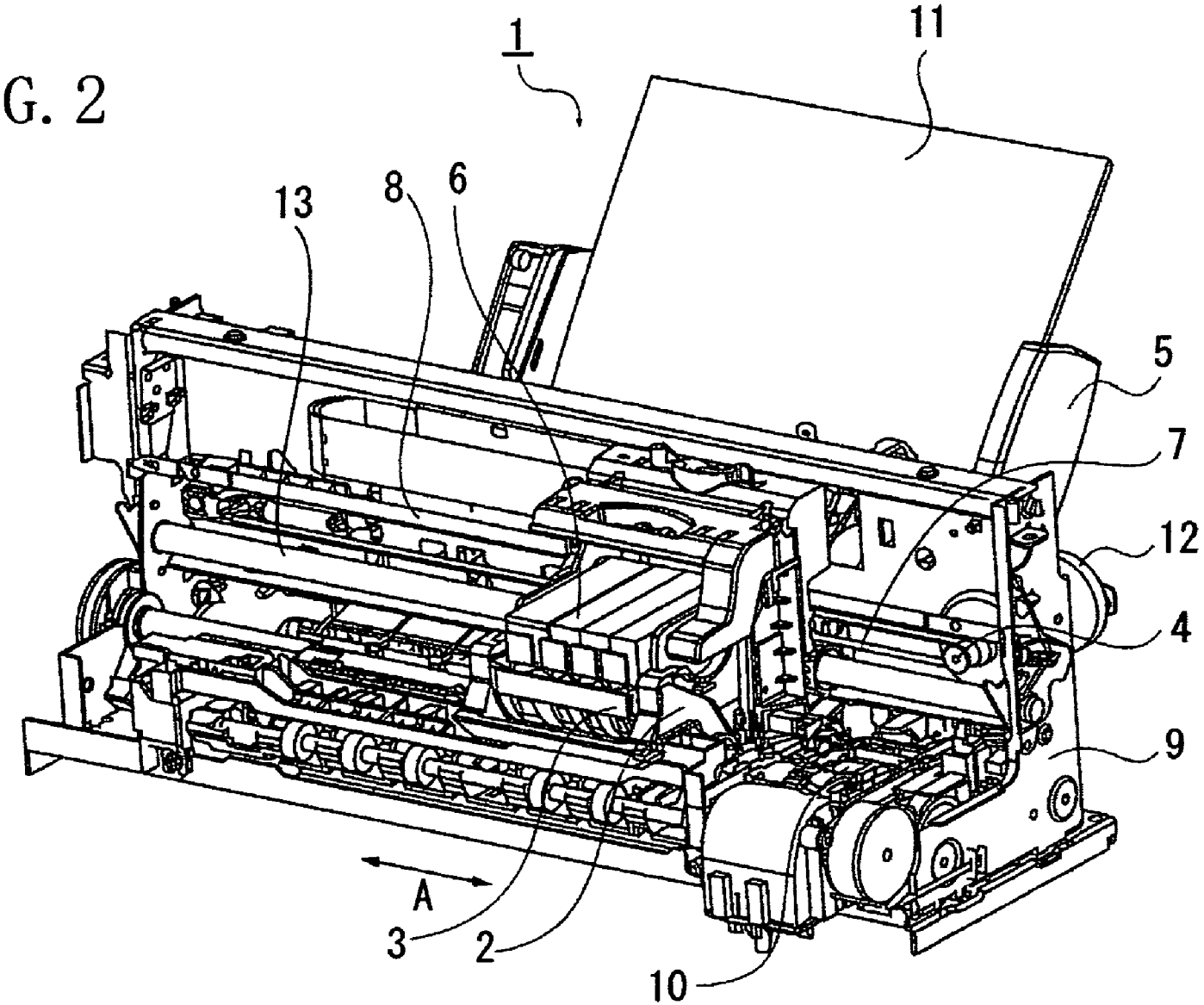
FIG. 2 is an external perspective view of an inkjet recording apparatus according to an exemplary embodiment of the present invention.

FIG. 2 is an external perspective view of an inkjet recording apparatus according to an exemplary embodiment of the present invention. An inkjet recording apparatus 1 includes a recording head 3 that discharges ink droplets according to an inkjet method. The recording head 3 is mounted on a carriage 2. A transmitting mechanism 4 transmits a driving force generated by a carriage motor 12 to the carriage 2. Consequently, the carriage 2 moves back and forth in the direction indicated by arrow A. As the carriage 2 moves back and forth, the inkjet recording apparatus 1 feeds a recording medium 11, such as recording paper, through a paper feed unit 5 and conveys the recording medium 11 to a recording position. At this recording position, the inkjet recording apparatus 1 performs recording by discharging ink droplets from the recording head 3 onto the recording medium 11.

Furthermore, the inkjet recording apparatus 1 moves the carriage 2 to the position of a recovery device 10 for maintaining the recording head 3 in a good condition. At this position, the inkjet recording apparatus 1 performs a discharge recovery process on the recording head 3 at intervals.

In addition to the recording head 3, ink cartridges 6 containing ink to be supplied to the recording head 3 are mounted on the carriage 2. The ink cartridges 6 can be detached from the carriage 2.

The inkjet recording apparatus 1 can perform color printing. Four ink cartridges 6, each containing black (K), cyan (C), magenta (M), and yellow (Y) inks, respectively, are mounted on the carriage 2. Each of the ink cartridges 6 is independently detachable from the carriage 2.

Moreover, the surfaces joining the carriage 2 and the recording head 3 are adequately in contact with each other to achieve and maintain the necessary electric connection. By applying energy to a recording element according to a recording signal, the recording head 3 discharges ink droplets selectively from a plurality of ink discharge ports. In particular, the recording head 3 in the present exemplary embodiment adopts an inkjet method in which heat energy is used for discharging ink. As the recording element, the recording head 3 includes an electrothermal conversion element that generates heat energy. The electrical energy applied to the electrothermal conversion element is converted into heat energy, and the heat energy is applied to the ink. The application of the heat energy generates film boiling, which causes a bubble to expand and contract, and the resulting pressure change is used to discharge an ink droplet from the ink discharge port. Each electrothermal conversion element is disposed corresponding to each ink discharge port. By applying a pulse voltage to the electrothermal conversion element according to a recording signal, ink is discharged from the corresponding ink discharge port.

As illustrated in FIG. 2, the carriage 2 is connected to a portion of the driving belt 7 of the transmitting mechanism 4, which transmits a driving force of the carriage motor 12. The carriage 2 is movably guided and supported along a guide shaft 13 in the direction indicated by arrow A. Accordingly, the carriage 2 moves back and forth along the guide shaft 13 according to the forward and reverse rotations of the carriage motor 12. Additionally, a scale 8 for indicating the absolute position of the carriage 2 is provided along the moving direction of the carriage 2 (the direction indicated by arrow A). In the present exemplary embodiment, the scale 8 is a transparent polyethylene terephthalate (PET) film on which black bars are printed at a given pitch. One end of the scale is fixed to a chassis 9 and the other end is held by a plate spring (not shown).

In the inkjet recording apparatus 1, a platen (not shown) is disposed facing the discharge port surface on which the discharge ports (not shown) of the recording head 3 are formed. The carriage 2, on which the recording head 3 is mounted, moves back and forth by the driving force of the carriage motor 12. At the same time, a recording signal is applied to the recording head 3 such that ink is discharged to perform recording over the entire width of the recording medium 11 conveyed on the platen.

Figure 3:
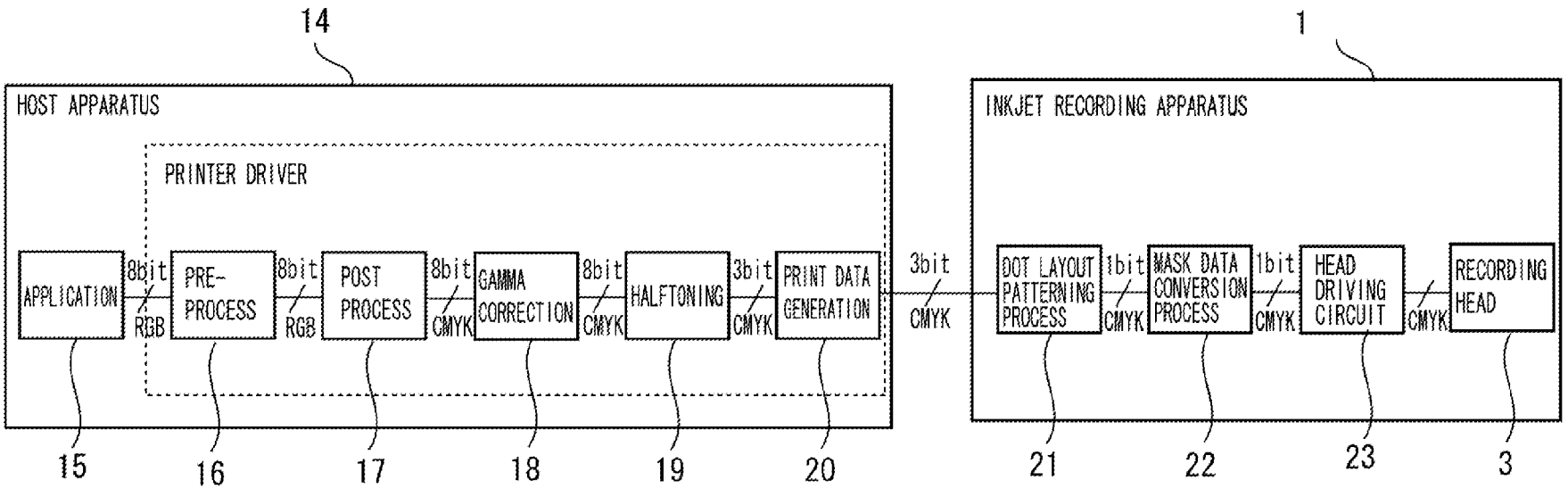
FIG. 3 is a block diagram of a print system according to an exemplary embodiment of the present invention.

FIG. 3 is a block diagram of a print system including the inkjet recording apparatus 1 according to the present exemplary embodiment. The print system according to the present exemplary embodiment includes the inkjet recording apparatus 1 illustrated in FIG. 2 and a host apparatus 14, which provides data for recording to the inkjet recording apparatus 1.

Programs, such as an application and a printer driver, run on an operating system (OS) in the host apparatus 14. An application 15 executes a process for generating image data to be printed with the inkjet recording apparatus 1. The image data or data that is to be edited can be downloaded onto the host apparatus 14 via various media. The downloaded data is displayed on a monitor of the host apparatus 14 and is edited or processed via the application 15. For example, image data R, G, and B of the sRGB format can be generated. The image data is transferred to the printer driver in response to a print instruction.

The printer driver performs a pre-process 16, post process 17, gamma correction 18, halftoning 19, and print data generation 20. First, the printer driver performs gamut mapping in the pre-process 16. The pre-process 16 performs data conversion for converting 8-bit image data R, G, and B into data R, G, and B within the gamut of the inkjet recording apparatus 1. This process uses a three-dimensional look-up table (LUT) to map the gamut reproduced with the image data R, G, and B of the sRGB format to the inside of the gamut reproduced with the inkjet recording apparatus 1. At the same time, the process uses interpolation calculation. The post process 17 obtains color separation data K, C, M, and Y corresponding to the combination of ink that reproduces the color represented by the data R, G, and B on which the above gamut mapping is performed. Similar to the pre-process 16, the post process 17 uses both the three-dimensional LUT and interpolation calculation. The gamma correction 18 performs gradation value conversion for each data of each color of the color separation data obtained by the post process 17. To be more precise, a conversion for linearly associating the above-mentioned color separation data with the gradation characteristic of the inkjet recording apparatus 1 is performed. The conversion uses a one-dimensional LUT corresponding to the gradation characteristic of each color ink of the inkjet recording apparatus 1. In the halftoning 19, quantization is performed to convert each of the 8-bit color separation data K, C, M, and Y into 3-bit data. In the present exemplary embodiment, an error diffusion method is used to convert the 8-bit data into 3-bit data. The 3-bit data is used as index data for indicating the layout pattern in the dot layout patterning process in a recording apparatus. Furthermore, the print data generation process 20 generates print data in which print control information is added to print image data containing the above-mentioned 3-bit index data (or gradation value information). The processes of the application and printer driver described above are performed by a central processing unit (CPU) according to the programs. The programs are read out from a read-only memory (ROM) or a hard disk, and a random access memory (RAM) is used as a work area for executing the processes.

The inkjet recording apparatus 1 performs a dot layout patterning process 21 and a mask data conversion process 22 on the data. The dot layout patterning process 21 lays out dots according to the dot layout pattern corresponding to the 3-bit index data, which is print image data. The dots are laid out for each pixel of the actual print image. By allocating a dot layout pattern corresponding to a gradation value to each pixel represented by 3-bit data as described above, discharge data (binary data) of either "1" or "0" is laid out on each basic pixel. The mask data conversion process 22 performs a masking process on the obtained 1-bit discharge data. That is, the recording head 3 records a scan area of a specific width with a plurality of scans, and the discharge data for each scan is generated by a process using a mask corresponding to each scan. The discharge data K, C, M, and Y for each scan is sent to a head driving circuit 23 at an appropriate timing. As a result, the recording head 3 is driven, and each ink is discharged according to the discharge data. A dedicated hardware circuit is used in each of the dot layout patterning process 21 and the mask data conversion process 22 described above. The processes are executed under the control of a CPU in the control unit of the inkjet recording apparatus 1. The processes can be performed by the CPU according to a program, or by a printer driver in the host apparatus 14.

In the present exemplary embodiment, a pixel is the smallest area in which gradation can be represented with n dots (where n is an integer greater than or equal to 0). A basic pixel is an area obtained by dividing the above-described pixel and is an area in which a dot is determined to be recorded or not. The size of the basic pixel is determined according to the recording resolution at which a dot is formed. For example, when the recording resolution of a dot is 1200 dpi, the size of the basic pixel is $1/1200$ inch.

Figure 4A:
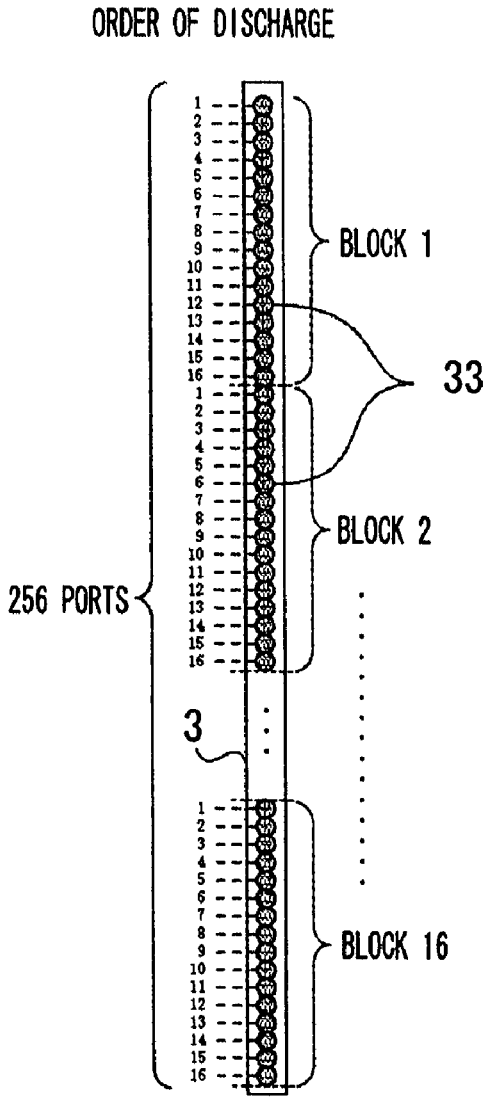
FIGS. 4A and 4B illustrate a time-division driving method according to an exemplary embodiment of the present invention.
Figure 4B:
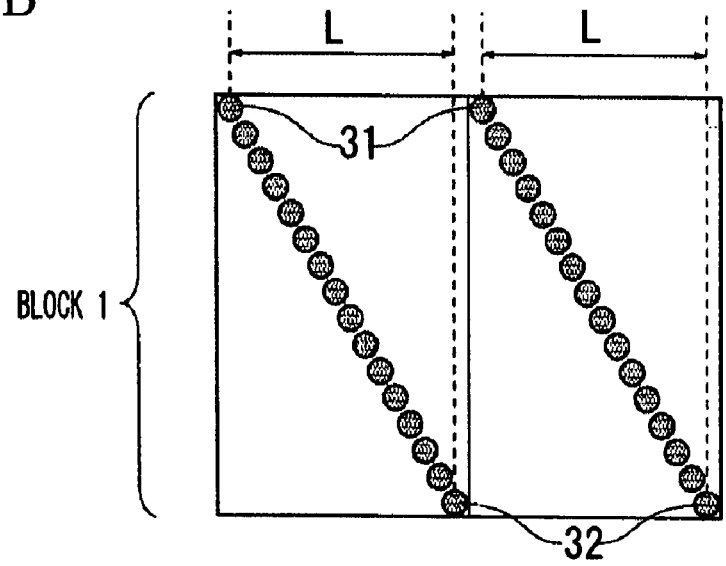

FIGS. 4A and 4B illustrate an example of a time-division driving method. When recording elements corresponding to the ink discharge ports of the recording head 3 are driven simultaneously, a large current is generated, thus causing a great voltage drop. To overcome this problem, the ink discharge ports are generally divided into a plurality of blocks. The recording elements of the ink discharge ports in each block are driven sequentially (i.e., adopting a time-division driving method). A time-division driving method selects a unit of recording elements in dispersed positions from a plurality of recording elements disposed corresponding to the ink discharge ports. The recording elements are time-divisionally driven in such units.

In FIG. 4A, the recording head 3 includes an ink discharge port array in which 256 ink discharge ports 33 are aligned. For ease of description, a configuration in which the recording head 3 includes one line of ink discharge array will be described. The ink discharge ports 33 in FIG. 4A are divided into blocks 1 to 16 from the top, and one block contains sixteen discharge ports 33. Moreover, each of the ink discharge ports 33 in each block is virtually numbered from 1 to 16, and the numbers indicate the order of discharge. The recording elements (not shown) corresponding to the first to the sixteenth ink discharge ports 33 are driven at specific time intervals, and ink droplets are discharged in order.

FIG. 4B illustrates dots formed on a recording medium when ink droplets are discharged from the sixteen ink discharge ports 33 of block 1 by a time-division driving method. The recording head 3 is scanned in the scanning direction. In FIG. 4B, the area indicated by a solid line indicates the size of a basic pixel in the scanning direction. A dot 31 formed by ink discharged from the first ink discharge port 33 and a dot 32 formed by ink discharged from the sixteenth ink discharge port 33 fit into the same basic pixel.

Figure 5:
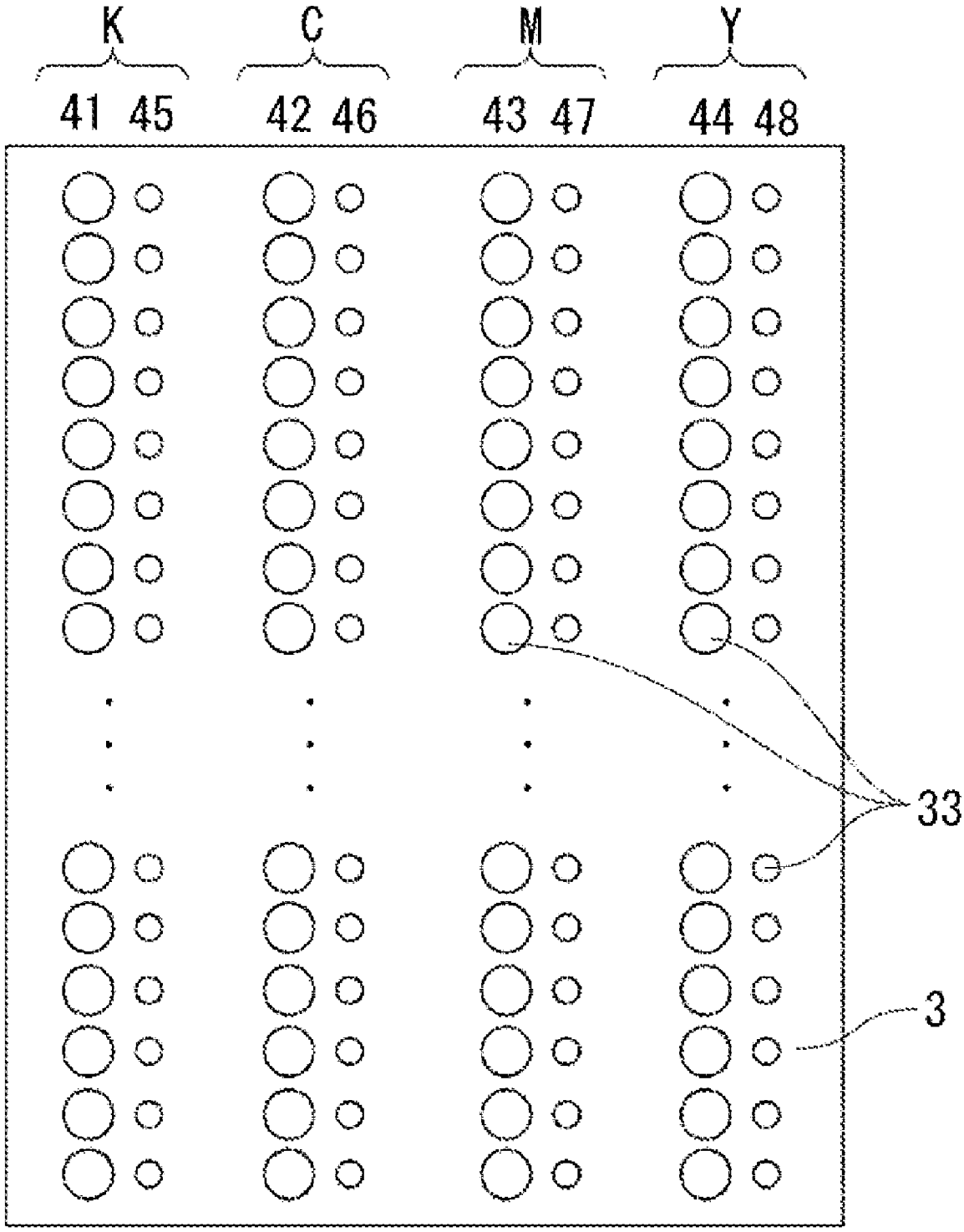
FIG. 5 illustrates the configuration of a recording head according to a first exemplary embodiment of the present invention.

FIG. 5 illustrates the configuration of the ink discharge ports 33 in the recording head 3 according to the present exemplary embodiment. The recording head 3 includes two ink discharge port arrays for each color. The diameters of the ink discharge ports 33 are different in the two ink discharge port arrays, and two types of ink droplets of different volumes can be discharged.

Amounts of ink discharged from the recording head 3 are 5 pl (picoliter) and 1 pl for each of colors K, C, M, and Y. Therefore, the recording head 3 has two ink discharge port arrays that can form large dots and small dots for each color. The recording head 3 includes ink discharge port arrays 41, 42, 43, and 44 that form large dots for colors K, C, M, and Y, respectively, and ink discharge port arrays 45, 46, 47, and 48 that form small dots for colors K, C, M, and Y, respectively.

Moreover, two ink discharge port arrays for each color are connected to a common ink chamber (not shown). In each ink discharge port array, 256 ink discharge ports 33 are disposed at $1/1200$-inch intervals (i.e., the resolution in the sub-scanning direction is 1200 dpi).

The inkjet recording apparatus 1 in the present exemplary embodiment drives the recording elements disposed in the ink discharge port arrays 41, 42, 43, and 44 that form large dots of 5 pl at a resolution of 1200 dpi. The ink discharge ports 33 corresponding to the recording elements discharge ink droplets of large volume. In addition, the inkjet recording apparatus 1 drives the recording elements disposed in the ink discharge port arrays 45, 46, 47, and 48 that form small dots of 1 pl at a resolution of 600 dpi. The ink discharge ports 33 corresponding to the recording elements discharge ink droplets of small volume.

FIGS. 6A and 6B illustrate dot layout patterns corresponding to each gradation value (0 to 5) index data composed of 6 values for each of a large dot and a small dot in the present exemplary embodiment. In FIG. 6A, "1" and "0" indicate discharge and non-discharge of an ink droplet. In the present exemplary embodiment, a layout pattern of dots on one pixel in gradation representation is determined based on a gradation value of index data converted from color separation data K, Y, M, and C.

In FIG. 6A, the vertical direction of each dot layout pattern corresponds to the direction in which the ink discharge ports 33 are aligned, and the horizontal direction corresponds to the scanning direction. Both the large and small dots are formed at a resolution of 1200 dpi in the direction of the alignment. In the scanning direction, the large dot is formed at a resolution of 1200 dpi, and the small dot is formed at 600 dpi. Therefore, large dots are laid out at a higher recording density in the scanning direction as compared to small dots.

As illustrated in FIG. 6A, the large dots are laid out on four basic pixels obtained by dividing one pixel into two in both the vertical and horizontal directions. The small dots are laid out on two basic pixels obtained by dividing one pixel into two only in the vertical direction.

In the present exemplary embodiment, the layout of large dots and small dots on one pixel is determined based on index data composed of six values for each of colors of K, Y, M, and C. However, as illustrated in FIG. 6B, only large dots need to be formed based on index data composed of four values for colors that do not require a high gradation characteristic. Such colors are black, which is well-used for recording characters, and yellow, which has low visibility. As described above, in the present exemplary embodiment, it is not necessary to form small dots at a low resolution as compared to large dots for all colors. The above configuration can be applied to at least one color.

Figure 1B:
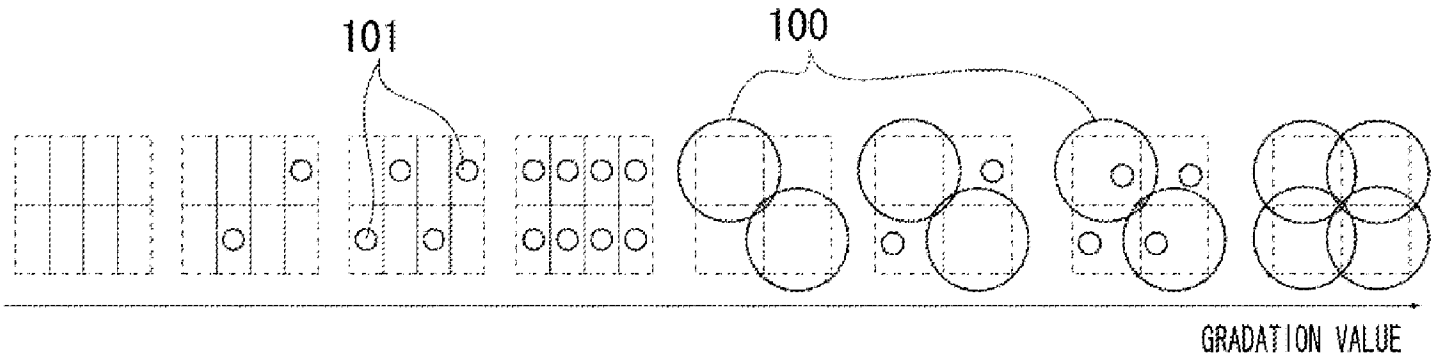
FIG. 1B PRIOR ART

According to the present exemplary embodiment, since the resolution of a small dot is set lower than that of a large dot, the displacement of the position where a small dot is formed can be reduced. Therefore, the degradation of image quality can be reduced. Additionally, the amount of data can be decreased as compared to a conventional inkjet recording apparatus as illustrated in FIG. 1B.

Second Exemplary Embodiment

A second exemplary embodiment of the present invention will be described. Description of the configuration similar to that of the first exemplary embodiment will not be repeated, and components similar to those of the first exemplary embodiment are denoted by the same reference numerals.

Figure 7:
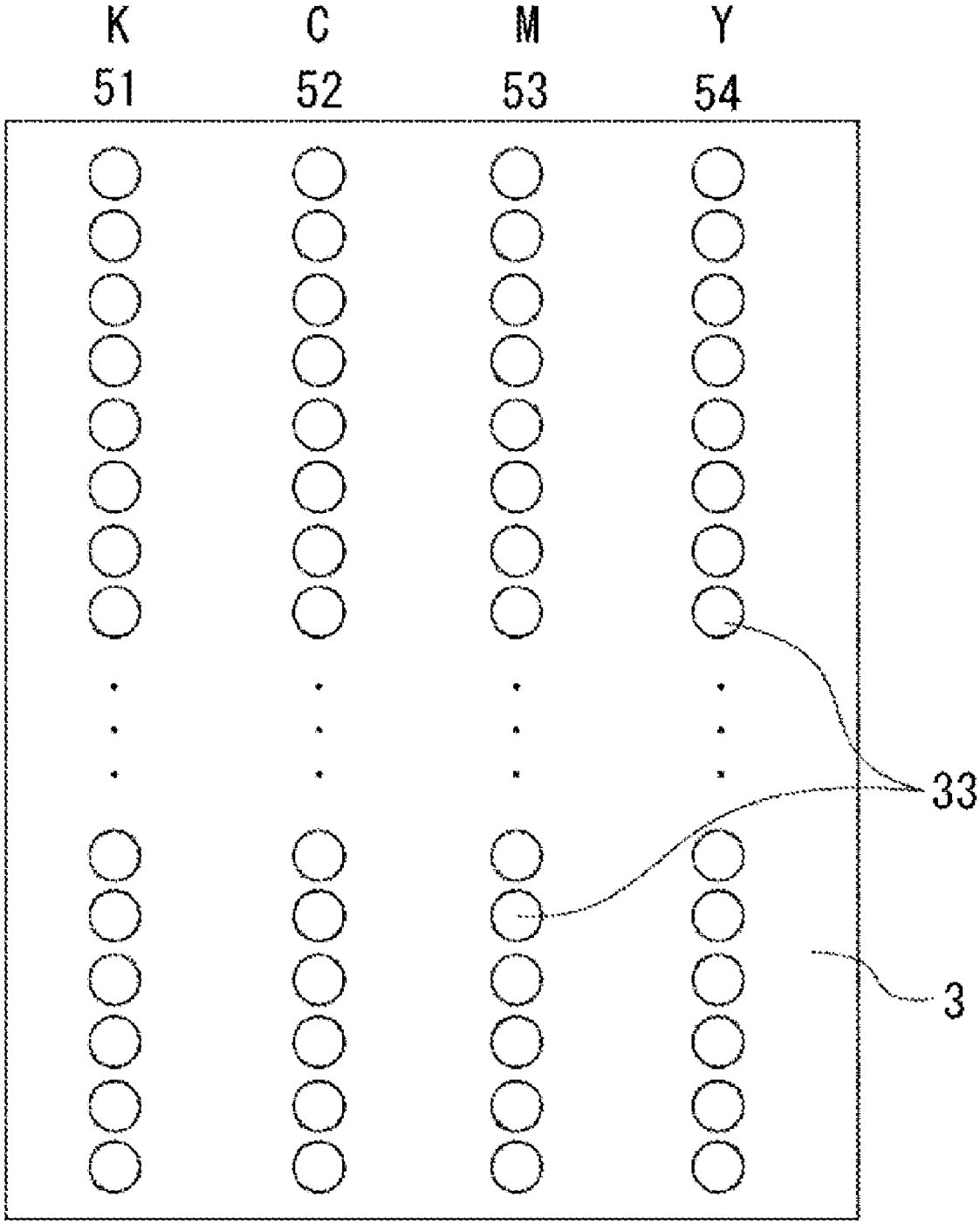
FIG. 7 illustrates the configuration of a recording head according to a second exemplary embodiment of the present invention.

FIG. 7 illustrates a recording head 3 according to the present exemplary embodiment. In the first exemplary embodiment, ink discharge ports 33 are of different diameters corresponding to large and small ink droplets. In the present exemplary embodiment, the recording head 3 includes ink discharge port arrays 51, 52, 53, and 54 whose ink discharge ports 33 have the same diameters, for respective colors K, C, M, and Y. The volumes of the ink droplets discharged from each ink discharge port 33 of the ink discharge arrays 51, 52, 53, and 54 are divided into large ink droplets and small ink droplets by using a piezoelectric method.

Figure 8:
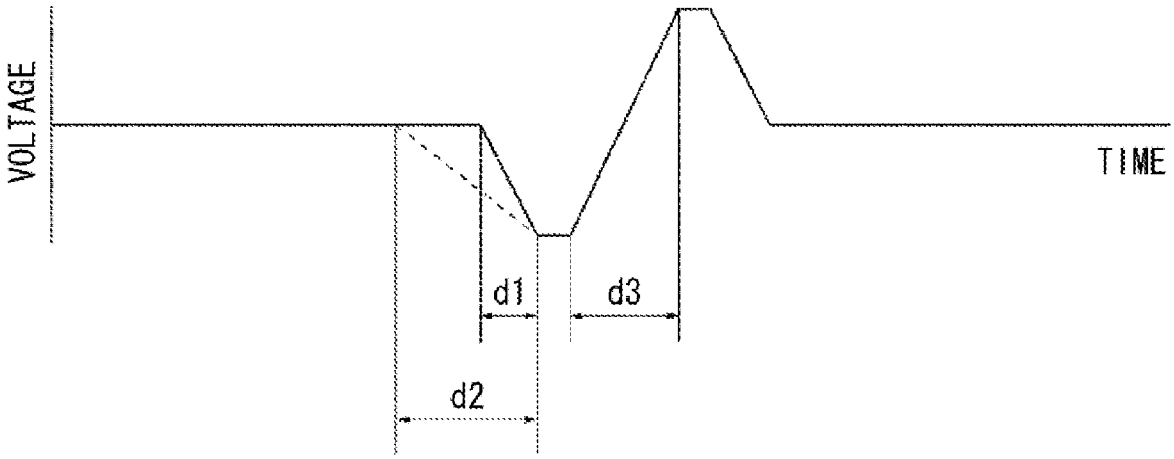
FIG. 8 illustrates a driving waveform in a piezoelectric method according to the second exemplary embodiment of the present invention.

In a piezoelectric method, distortion is generated in the crystal lattice of a piezoelectric element according to an applied voltage. Consequently, the piezoelectric element generates mechanical energy to discharge ink. In general, the volume of an ink droplet in the piezoelectric method can be changed by changing the driving waveform for driving the piezoelectric element. FIG. 8 illustrates the driving waveform for discharging an ink droplet. In FIG. 8, if the voltage state of the piezoelectric element changes rapidly to a low voltage state during a time interval d1 as indicated by a solid line, the ink meniscus sinks in greatly inside the ink discharge port. As a result, a small ink droplet can be discharged. On the contrary, if, during a time interval d2, the piezoelectric element slowly reaches a low voltage state as indicated by a broken line, the fluctuation of the meniscus is small. As a result, a large ink droplet can be discharged.

In the present exemplary embodiment, ink discharge ports having the same diameter are aligned for each color in the ink discharge arrays of an inkjet recording apparatus. The inkjet recording apparatus performs recording while changing the volume of the ink droplets discharged from the ink discharge arrays according to a piezoelectric method. The resolution of the small dot in the scanning direction is set lower than the resolution of the large dot. As a result, the displacement of the position where a small dot is formed can be reduced, and the degradation of image quality can be decreased.

Third Exemplary Embodiment

A third exemplary embodiment of the present invention will be described. Description of the configuration similar to that of the first and second exemplary embodiments will not be repeated, and components similar to those of the first exemplary embodiment are denoted by the same reference numerals.

A recording head 3 of the inkjet recording apparatus 1 in the present exemplary embodiment includes three ink discharge arrays for each color. The diameters of the ink discharge port 33 are different in the three ink discharge arrays so that the recording head 3 can discharge three types of ink droplets of different volumes.

Figure 9:
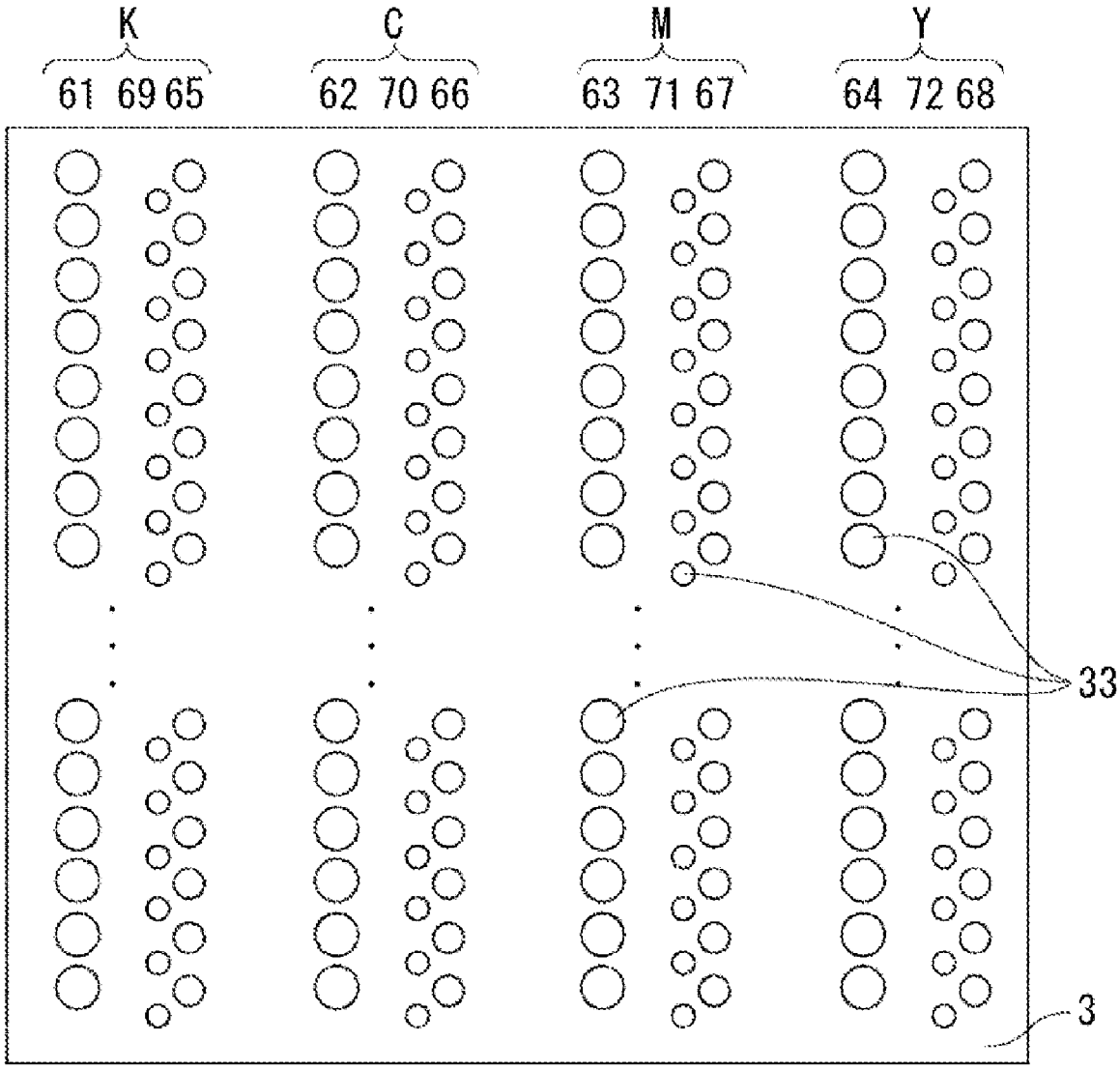
FIG. 9 illustrates the configuration of a recording head according to a third exemplary embodiment of the present invention.

FIG. 9 illustrates the ink discharge ports 33 of the recording head 3 according to the present exemplary embodiment. The recording head 3 includes three ink discharge arrays that can form large, medium, and small dots respectively. The ink discharge port arrays discharge three types of ink droplets, i.e., amounts of ink discharge of 5 pl, 2 pl, and 1 pl, for each of the colors K, C, M, and Y. The recording head 3 includes ink discharge port arrays 61, 62, 63, and 64 that form large dots, ink discharge port arrays 65, 66, 67, and 68 that form medium dots, and ink discharge port arrays 69, 70, 71, and 72 that form small dots, for each color. Moreover, the three ink discharge port arrays of each color are connected to a common ink chamber (not shown).

In the present exemplary embodiment, the recording elements disposed on the 5 pl ink discharge port array that form large dots are driven at a resolution of 1200 dpi. On the other hand, the recording elements disposed on the 2 pl and 1 pl ink discharge port arrays that form medium dots and small dots are driven at a resolution of 600 dpi to record an image. As described above, the resolutions of the medium dot and the small dot in the scanning direction are set lower than that of the large dot.

FIG. 10 illustrates the dot layout patterns of large dots, medium dots, and small dots corresponding to each gradation value (0 to 7) of index data composed of eight values. As illustrated in FIG. 10, the large dot is formed at a resolution of 1200 dpi in the scanning direction, and the medium and small dots are formed at a resolution of 600 dpi. Therefore, the large dot is laid out at a higher recording density in the scanning direction as compared to the medium and small dots. In FIG. 10, the large dot is laid out on a basic pixel obtained by dividing one pixel into two in both the vertical and horizontal directions. The medium and small dots are laid out on a basic pixel obtained by dividing one pixel into two only in the vertical direction.

As in the previous exemplary embodiments, only large dots need to be formed based on index data of four values as illustrated in FIG. 6B for colors that do not require high gradation characteristic in the present exemplary embodiment. Such colors are black, which is well-used for recording characters, and yellow, which has low visibility. In the present exemplary embodiment, it is not necessary to form medium and small dots at a lower resolution than large dots for all colors. The above configuration can be applied to at least one color.

According to the present exemplary embodiment, the medium and small dots are formed at a lower resolution as compared to the large dot. Therefore, the displacement of the position where the medium and small dots are formed can be reduced, and the degradation of image quality can be decreased.

Fourth Exemplary Embodiment

A fourth exemplary embodiment of the present invention will be described. Description of the configuration similar to that of the first to third exemplary embodiments will not be repeated, and components similar to those of the first exemplary embodiment are denoted by the same reference numerals.

The inkjet recording apparatus 1 in the present exemplary embodiment includes a recording head 3 that can discharge three types of ink droplets of different volumes as illustrated in FIG. 9, similar to the third exemplary embodiment.

In the present exemplary embodiment, the recording elements disposed on the 5 pl ink discharge port arrays 61, 62, 63, and 64 that form a large dot is driven at a resolution of 1200 dpi. The recording elements disposed on the 2 pl ink discharge port arrays 65, 66, 67, and 68 that form a medium dot is also driven at a resolution of 1200 dpi. On the other hand, the recording elements disposed on the 1 pl ink discharge port arrays 69, 70, 71, and 72 that form a small dot are driven at a resolution of 600 dpi. As described above, the resolution of the small dot in the scanning direction is set lower than the resolutions of the large and medium dots.

FIG. 11 illustrates dot layout patterns of large, medium, and small dots corresponding to each gradation value (0 to 7) of index data composed of eight values. The large and medium dots are formed at a resolution of 1200 dpi in the scanning direction, and the small dot is formed at a resolution of 600 dpi. Therefore, the large and medium dots are laid out at a higher recording density as compared to the small dot. In FIG. 11, the large and medium dots are laid out on four basic pixels obtained by dividing one pixel into two in both the vertical and horizontal directions. The small dot is laid out on two basic pixels obtained by dividing one pixel into two only in the vertical direction.

As in the previous exemplary embodiments, only large dots need to be formed based on index data composed of four values as illustrated in FIG. 6B for colors that do not require high gradation characteristic in the present exemplary embodiment. Such colors are black, which is well-used for recording characters, and yellow, which has low visibility. In the present exemplary embodiment, it is not necessary to form small dots at a lower resolution than large and medium dots for all colors. The above configuration can be applied to at least one color.

According to the present exemplary embodiment, the resolution of the small dot in the scanning direction is set lower than the resolution of the large and medium dots. As a result, the displacement of the position where a small dot is formed can be reduced, and the degradation of image quality can be decreased.

Fifth Exemplary Embodiment

A fifth exemplary embodiment of the present invention will be described. Description of the configuration similar to that of the first to fourth exemplary embodiments will not be repeated, and components similar to those of the first exemplary embodiment are denoted by the same reference numerals.

The inkjet recording apparatus 1 in the present exemplary embodiment includes a recording head 3 that can discharge three types of ink droplets of different volumes as illustrated in FIG. 9, similar to the third and fourth exemplary embodiments.

In the present exemplary embodiment, the recording elements disposed on the 5 pl ink discharge port arrays 61, 62, 63, and 64 that form a large dot is driven at a resolution of 2400 dpi. The recording elements disposed on the 2 pl ink discharge port arrays 65, 66, 67, and 68 that form a medium dot is driven at a resolution of 1200 dpi. The recording elements disposed on the 1 pl ink discharge port arrays 69, 70, 71, and 72 that form a small dot are driven at a resolution of 600 dpi. As described above, dots with smaller diameters are formed at a lower resolution in the inkjet recording apparatus 1.

FIG. 12 illustrates dot layout patterns of large, medium, and small dots corresponding to each gradation value (0 to 7) of index data composed of eight values. The large dot is formed at a resolution of 2400 dpi in the scanning direction, the medium dot at 1200 dpi, and the small dot at 600 dpi. Therefore, the large dot is laid out at a higher recording density as compared to the medium and small dots. In FIG. 12, the large dots are laid out on eight basic pixels obtained by dividing one pixel into two in the vertical direction and into four in the horizontal direction. The medium dots are laid out on four basic pixels obtained by dividing one pixel into two in both the vertical and horizontal directions. The small dots are laid out on two basic pixels obtained by dividing one pixel into two only in the vertical direction.

As in the previous exemplary embodiments, only large dots need to be formed based on index data composed of four values as illustrated in FIG. 6B for colors that do not require high gradation characteristic in the present exemplary embodiment. Such colors are black, which is well-used for recording characters, and yellow, which has low visibility. As described above, in the present exemplary embodiment, it is not necessary for smaller dots to have lower resolutions for all colors. The above configuration can be applied to at least one color.

According to the present exemplary embodiment, a lower resolution is set for dots of smaller diameters. As a result, the displacement of the position where a small dot is formed can be reduced, and the degradation of image quality can be decreased.

Sixth Exemplary Embodiment

A sixth exemplary embodiment of the present invention will be described. Description of the configuration similar to that of the first to fifth exemplary embodiments will not be repeated, and components similar to those of the first exemplary embodiment are denoted by the same reference numerals.

Figure 13:
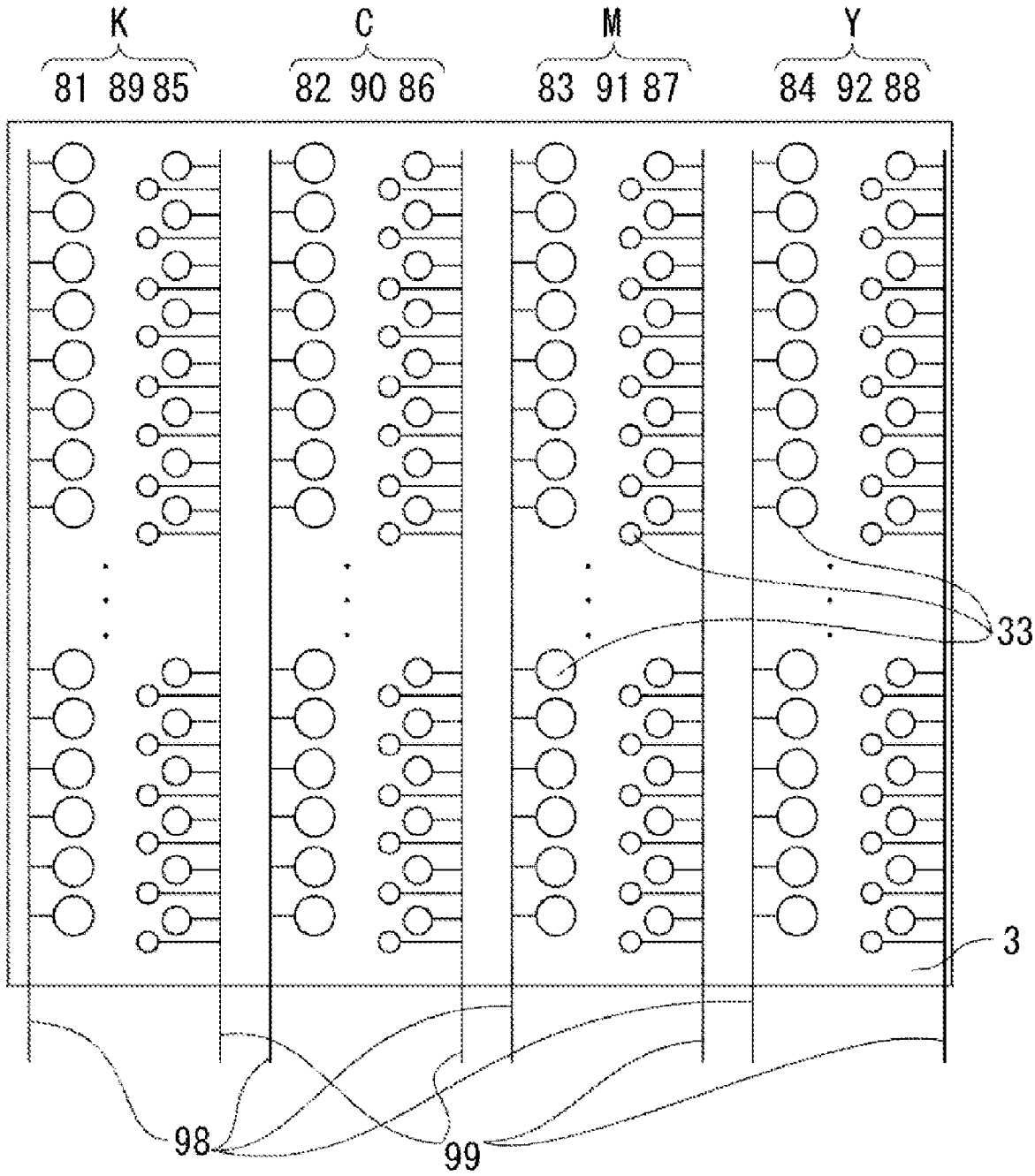
FIG. 13 illustrates the configuration of a recording head according to a sixth exemplary embodiment of the present invention.

FIG. 13 illustrates a recording head 3 according to the present exemplary embodiment. The recording head 3 includes three ink discharge arrays that can form large, medium, and small dots. The ink discharge port arrays discharge three types of ink droplets, i.e., amounts of ink discharge of 5 pl, 2 pl, and 1 pl, for each of colors K, C, M, and Y. The recording head 3 includes ink discharge port arrays 81, 82, 83, and 84 that form large dots, 85, 86, 87, and 88 that form medium dots, and 89, 90, 91, and 92 that form small dots, for each color.

The resolution of the large dot in the scanning direction is set higher than that of the medium and small dots. To be more precise, the large dot is formed at a resolution of 1200 dpi in the scanning direction, and the medium and small dots at 600 dpi.

Moreover, the recording head 3 includes a heater (not shown) as a recording element, corresponding to each ink discharge port 33 for discharging ink. The ink near each ink discharge port 33 is rapidly heated by the heater to generate a bubble and is discharged from the ink discharge port 33.

The recording head 3 is characteristic in including a common wiring 99 between the heaters of the ink discharge port arrays of medium and small dots for each color. A pulse current acting as a driving signal is supplied to the heater disposed at the ink discharge ports of the medium and small dots via the common wiring 99. Consequently, the ink droplets are discharged by the generated bubbles. A wiring 98 set on the heater of the ink discharge port array for the large dot is set independently.

Figure 14:
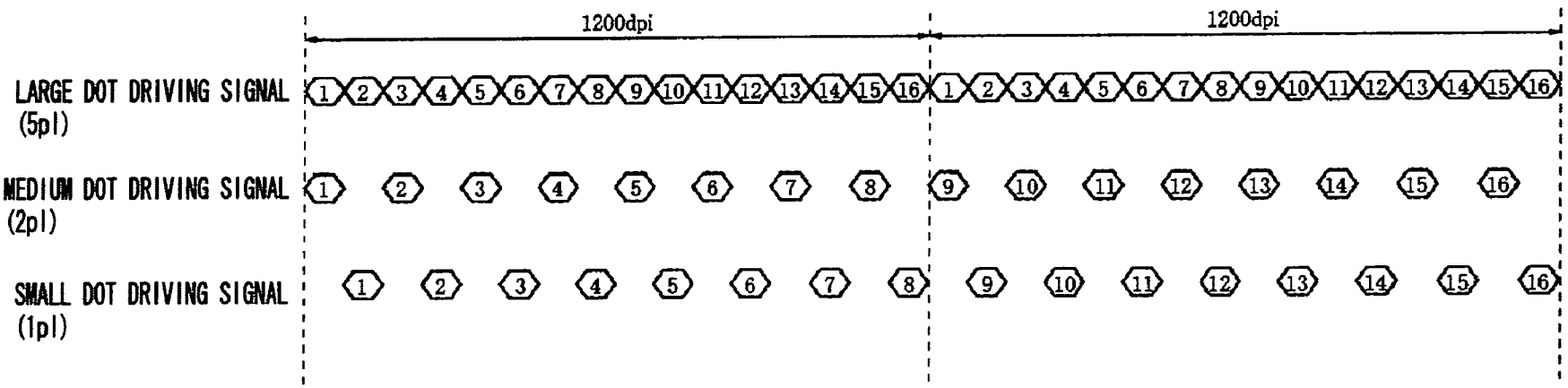
FIG. 14 is a pattern diagram of driving signals according to a sixth exemplary embodiment of the present invention.

FIG. 14 illustrates driving signals supplied to the heaters corresponding to the ink discharge ports 33 of each discharge port array of the large, medium, and small dots. There are sixteen ink discharge ports 33 in one block. The large dot is formed at a resolution of 1200 dpi. Therefore, the driving signal is supplied sequentially to the first to sixteenth heaters disposed on the ink discharge ports of the large dot according to a resolution of 1200 dpi. On the other hand, the medium and small dots are formed at a resolution of 600 dpi. Therefore, one cycle of driving signals is supplied to the first to sixteenth heaters of the medium and small dots while two cycles of driving signals are supplied to the heaters of the ink discharge port array of the large dot.

A common wiring supplies driving signals to the heaters of the medium dots and the small dots. Consequently, recording signals corresponding to the medium dots and to the small dots cannot be sent simultaneously. To overcome this problem, the driving signals are supplied alternately to the heaters of the ink discharge port arrays of the medium dots and the small dots at a delayed timing. The wiring 98 for the heater of the ink discharging port array of the large dot is set independently, so that ink can be discharged from each ink discharge port at a specific resolution.

The dot layout patterns of large, medium, and small dots corresponding to each gradation value (0 to 7) of the index data composed of eight values can be applied to the present exemplary embodiment. This is similar to FIG. 10 of the third exemplary embodiment.

In the present exemplary embodiment, the resolutions of the medium and small dots in the scanning direction are set lower than that of the large dot. As a result, the displacement of the impact position of the medium and small dots can be reduced, and the degradation of image quality can be decreased. Furthermore, the common wiring 99 of the heaters of the ink discharge port arrays for forming medium and small dots can decrease the number of wirings.

Seventh Exemplary Embodiment

A seventh exemplary embodiment of the present invention will be described. Description of the configuration similar to that of the first to sixth exemplary embodiments will not be repeated, and components similar to those of the first exemplary embodiment are denoted by the same reference numerals.

A recording head 3 in the present exemplary embodiment has a configuration similar to that of the sixth exemplary embodiment illustrated in FIG. 13. The recording head 3 includes three ink discharge arrays that can form large, medium, and small dots. The ink discharge port arrays discharge three types of ink droplets, i.e., amounts of ink discharge of 5 pl, 2 pl, and 1 pl, for each of colors K, C, M, and Y. The resolution of the dots in the scanning direction becomes lower as the diameter of the dot decreases. To be more precise, the large dot is formed at a resolution of 2400 dpi in the scanning direction, the medium dot at 1200 dpi, and the small dot at 600 dpi.

The recording head 3 includes a common wiring 99 between the heaters of the ink discharge port arrays of medium and small dots for each color. A wiring 98 set on the heater of the ink discharge port array for the large dot is set independently.

Figure 15:
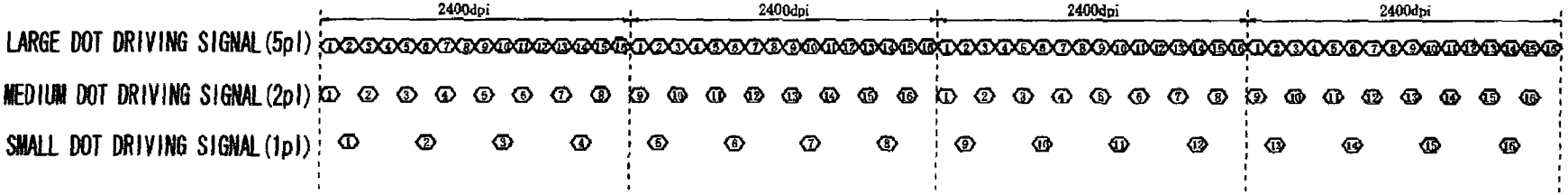
FIG. 15 is a pattern diagram of driving signals according to a seventh exemplary embodiment of the present invention.

FIG. 15 illustrates driving signals supplied to the heaters disposed on each ink discharge port array of the large, medium, and small dots. A driving signal is supplied sequentially to the heaters disposed on the ink discharge ports of the large dots according to the resolution of 2400 dpi. On the other hand, a common wiring supplies driving signals to the heaters of the medium and small dots. Therefore, recording signals cannot be supplied to the heaters of the medium and of the small dots simultaneously. To overcome this problem, the driving signals are supplied alternately to the heaters of the ink discharge port arrays of the medium dot formed at a resolution of 1200 dpi and of the small dot formed at a resolution of 600 dpi at delayed timing. The wiring 98 for the heater of the ink discharging port array of the large dot is set independently, so that ink can be discharged from each ink discharge port at a specific resolution.

The dot layout patterns of large, medium, and small dots corresponding to each gradation value (0 to 7) of the index data composed of eight values can be applied to the present exemplary embodiment. This is similar to FIG. 12 of the fifth exemplary embodiment.

According to the present exemplary embodiment, a resolution of a dot is set lower as the diameter of the dot decreases. Therefore, the displacement of the position where the small dot is formed can be reduced, and the degradation of image quality can be decreased. Moreover, the common wiring 99 of the heaters of the ink discharge port arrays for forming medium and small dots can decrease the number of wirings.

Other Exemplary Embodiments

In the above-described exemplary embodiments, the inkjet recording apparatus discharges ink droplets and records an image using the time-division driving method. However, the present invention does not require adopting the time-division driving method.

When a time-division driving method is adopted, ink droplets are discharged sequentially from each ink discharge port at specific time intervals. Consequently, the position of a dot formed by discharging ink from each ink discharge port is displaced in the scanning direction, which may cause the degradation of image quality. To describe in detail using FIG. 4B, a dot 31 formed by the first ink discharge port and a dot 32 formed by the sixteenth ink discharge port exist at a distance L from each other in the scanning direction. Additionally, the dots are formed to be within the same basic pixel. Therefore, the dot layout becomes dispersed when dots are formed at a distance from each other in the main scanning direction. As the distance L increases, granular quality becomes conspicuous, thus leading to the degradation of image quality.

The distance L depends on the recording resolution. The distance L decreases as the resolution in the main scanning direction becomes higher and the size of the basic pixel becomes smaller. As a result, the dispersion of the dot layout can be reduced. For example, when the resolution in the scanning direction is 600 dpi, the size of a basic pixel is 1/600 inch, and when the resolution is 1200 dpi, the size of a basic pixel is 1/1200 inch. The size of the basic pixel at 1200 dpi is one-half of that at 600 dpi.

However, in a case where the resolution is 1200 dpi, data indicating whether to discharge ink droplets is required at half the dot intervals of the case where the resolution is 600 dpi. Consequently, the amount of image data becomes larger when dots are formed at a high resolution. Therefore, when a high resolution is set for forming all dots, the amount of image data also increases.

In the first to seventh exemplary embodiments, the large dot is formed at a higher resolution as compared to a small dot or both the medium and small dots. The large dot is easy to recognize visually and has the most effect on image quality degradation due to the dispersion in the dot layout. Therefore, the degradation of image quality can be decreased effectively by forming large dots at a higher resolution than the small dots. On the other hand, a small dot is difficult to recognize visually and does not often cause image quality degradation due to the dispersion in the dot layout. Therefore, an increase in the amount of image data when forming all dots at a high resolution can be reduced by setting the resolution of the small dots lower than that of the large dots.

Moreover, the above exemplary embodiments have described examples in which two dots of different diameters, i.e., large and small dots, or three dots of different diameters, i.e., large, medium, and small dots, are used. However, the present invention is not limited to the above configuration, and the present invention can be applied to four or more dots of different diameters.

In the above-described exemplary embodiments, a dot with the largest diameter among dots of a plurality of diameters is referred to as a first dot (or large dot). The dot with the smallest diameter is referred to as a second dot (or small dot). The resolution of the second dot is set lower than that of the first dot. With the above-described configuration, the displacement of the position where the dot with a small diameter is formed can be reduced, and the degradation of image quality can be decreased.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2006-226702 filed Aug. 23, 2006, which is hereby incorporated by reference herein in its entirety.

What is claimed is:

1. A recording apparatus comprising:

a recording unit configured to record a first dot and a second dot having a diameter smaller than that of the first dot on a recording medium; and a scanning unit configured to move the recording unit in a scanning direction, wherein a recording resolution of the second dot in the scanning direction is lower than a recording resolution of the first dot in the scanning direction, wherein the recording unit is configured to record a third dot having a diameter smaller than that of the first dot and larger than that of the second dot, and wherein a recording resolution of the third dot in the scanning direction is equal to a recording resolution of the second dot in the scanning direction.

2. The recording apparatus according to claim 1, wherein the recording unit includes a first recording element disposed corresponding to a discharge port for recording the first dot, a second recording element disposed corresponding to a discharge port for recording the second dot, a third recording element disposed corresponding to a discharge port for recording the third dot, and a common wiring provided for the second element and the third element.

3. The recording apparatus according to claim 2, wherein the second recording element and the third recording element are driven alternately.

* * * * *